US005555644A

United States Patent [19]

Voegtline

[11] Patent Number: 5,555,644

[45] Date of Patent: Sep. 17, 1996

[54] FLUID CYLINDER RETRACTION LOCKING DEVICE

[75] Inventor: Rodney Voegtline, Greenbay, Wis.

[73] Assignee: W.R. Grace & Co.-Conn., New York, N.Y.

[21] Appl. No.: 323,973

[22] Filed: Oct. 17, 1994

[51] Int. Cl.[6] ..... F26B 13/00

[52] U.S. Cl. ..... 34/444; 34/631; 34/640; 91/170 MP

[58] Field of Search ..... 34/629, 631, 640, 34/273, 444; 91/170 MP; 220/1.5; 312/333

[56] References Cited

U.S. PATENT DOCUMENTS 5,259,124 11/1993 Poterala ..... 34/242

5,303,484 4/1994 Hagen et al. ..... 34/629

5,384,969 1/1995 Troetscher et al. ..... 34/629

*Primary Examiner*—James Larson

*Attorney, Agent, or Firm*—William L. Baker; Craig K. Leon; Kevin S. Lemack

[57] ABSTRACT

Method and apparatus for eliminating the danger of inadvertent failure of a weight-bearing retraction system, such as a dryer hood retraction system. A load lifted using a fluid cylinder can be easily locked in place against gravity by using a double rod ended cylinder, where the rod end not exerting the force is permitted to move through a clearance hole while the load is being lifted, and is then blocked to prevent the return motion until the load is to be released.

12 Claims, 3 Drawing Sheets

FLUID CYLINDER RETRACTION LOCKING DEVICE

BACKGROUND OF THE INVENTION

In web printing and drying operations, it is often desirable that the web be contactlessly supported in order to avoid damage to the web itself or to the coating (such as ink) previously applied to one or more surfaces of the web. One conventional arrangement for contactlessly supporting the web includes horizontal upper and lower arrays of air bars between which the web floatingly travels. Hot air issuing from the air bars both dries and supports the web. Such dryers for running webs and the like are typically designed with upper and lower hoods. Each array of airs bars is in air-receiving communication with upper and lower headers. The upper header and upper air bar assembly comprise the upper hood of the dryer, and the lower header and lower air bar assembly comprise the lower hood of the dryer. These upper and lower hoods are retractable with respect to each other, primarily to allow a web to be threaded through the machine, and also to allow for the periodic maintenance and replacement of the air bars and other dryer internals.

The upper and lower hood retraction system generally utilizes fluid cylinders to retract the hoods, the fluid cylinders being driven either pneumatically or hydraulically. However, sudden inadvertent pressure loss or the like to the cylinders can cause the retraction system to fail, and the dryer hood to collapse. In order to avoid such a catastrophe, the retracted hood is usually manually blocked in place or automatically pinned in place using auxiliary equipment. However, such a safety measure is generally inefficient and unreliable.

SUMMARY OF THE INVENTION

The problems of the prior art have been overcome by the present invention, which provides a method and apparatus for eliminating the danger of inadvertent failure of a weight-bearing retraction system, such as a dryer hood retraction system. More specifically, a load lifted using a fluid cylinder can be easily locked in place against gravity by using a double rod ended cylinder, where the rod end not exerting the force is permitted to move through a clearance hole while the load is being lifted, and is then blocked to prevent the return motion until the load is to be released.

It is therefore an object of the present invention to provide a simple and efficient method of preventing dryer hood collapse when lifting with a pneumatic or hydraulic cylinder.

It is a further object of the present invention to provide apparatus for accomplishing the aforementioned method.

These and other objects of the invention will become apparent upon reference to the following detailed description of the invention and accompanying drawings.

DETAILED DESCRIPTION OF THE INVENTION

Figure 1:
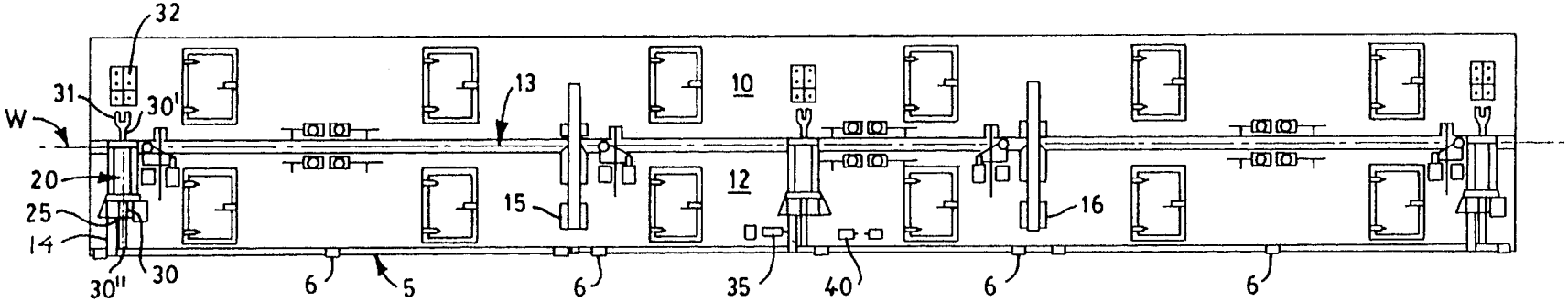
FIG. 1 is a tending side view of a web flotation dryer illustrated in the closed position.

Although for illustration purposes the dryer shown is a web flotation dryer, it should be understood by those skilled in the art that the present invention is applicable to other types of dryers, such as roll support and arched dryers, and equipment other than dryers which utilize load-bearing retraction systems, especially fluid cylinder retraction systems. Similarly, although the dryer illustrated in the drawings includes three dryer zones, the present invention is applicable to dryers having any number of dryer zones.

Turning first to FIG. 1, there is shown a split enclosure drying hood including an upper hood 10 and a lower hood 12. In the closed position, a clearance gap 13 is formed between the hoods 10, 12 in which the traveling web W is floatingly supported between upper and lower air bar arrays (not shown) in air-receiving communication with the upper and lower hoods, respectively. The upper and lower hoods 10, 12 can be further separated from one another with a retraction system in order to thread the web through the dryer or maintain or replace dryer internals. Such a system is conventional in the art, and may for example include a guiding devices 15, 16 in addition to the retraction cylinder rod 30, along with associated equipment. The present invention is not limited to any particular retraction system.

Figure 3:
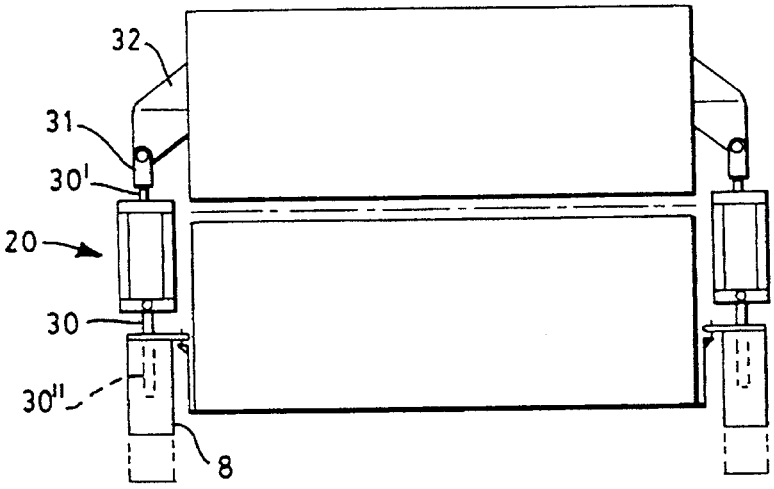
FIG. 3 is a side view of the dryer of FIG. 1.

The retraction system of the present invention comprises an air cylinder 20 (in the embodiment shown, three on each side of the dryer; the actual number used can vary and depends in part on the number of dryer zones and overall dryer length) that includes a double rod ended cylinder rod 30. One end 30' of the cylinder rod 30 is fixed to either the upper or lower hood of the dryer by any suitable means, such as clamp 31 and mounting bracket 32. The opposite end 30" of the double rod ended cylinder rod 30 is moveable through a clearance hole in the base 8 of the unit (FIG. 3), between a first open position (FIG. 4) and a second closed position (FIG. 3). Base 8 can be mounted directly to the dryer, or can be mounted on associated auxiliary dryer support equipment as indicated by the dotted lines in FIG. 3. As the retraction system operates to retract hood 10 from hood 12, the cylinder 20 moves accordingly.

Figure 2:
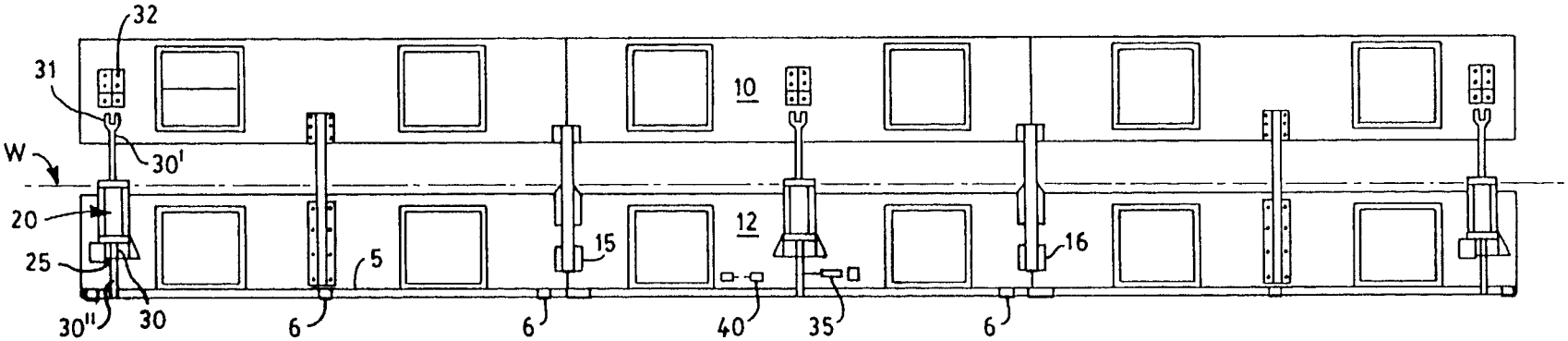
FIG. 2 is a drive side view of a web flotation dryer illustrated in the open position.
Figure 5:
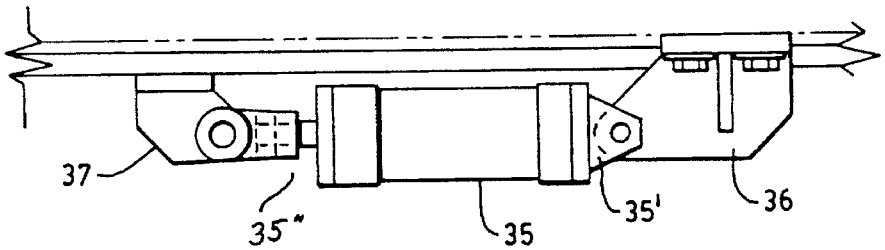
FIG. 5 is a side view of a fluid cylinder used to move the slide gate into the locked position.

In order to block the return movement of the cylinder rod 30 into the aperture in base 8, a mounting bracket stop plate 14 is provided, which is coupled to a flat bar 5 spanning the length of the dryer. A plurality of TEFLON strips 6 are placed along the length of flat bar 5 for ease of sliding the unit in place. The flat bar 5 is in turn coupled to a fluid cylinder 35, such as a hydraulic cylinder, the details of which are illustrated in Figure 5. The stationary end 35' of cylinder 35 is fixed to mounting bracket 36 as shown in FIG. 5. The rod end 35" of cylinder 35 is coupled to mounting plate 37, which in turn is fixed to mounting bracket stop plate 14 on one of the retraction devices. Actuation of the cylinder 35 causes mounting bracket stop plate 14 to move, which in turn causes flat bar 5 to move, thereby resulting in the movement of the other mounting bracket stop plates 12 of the other retraction locking devices. This movement shifts sliding gate 25 into and out of position, either blocking or opening the aperture in the base 8, as the case may be. Reference to FIG. 1 shows each mounting plate 14 in the far left position, which situates the sliding gate 25 out of cylinder rod 30 blocking position and allows the cylinder rod 30 to pass through the aperture in the base 8 (not shown). Reference to FIG. 2 shows each mounting plate 12 in a central blocking position, which situates the sliding gate 25 over the aperture in the base 8 and prevents the cylinder rod 30 from passing through that aperture, thereby locking it in place. Since the cylinder rod 30 is locked in place, failure of the retraction system will not result in the collapse of the load.

Figure 6:
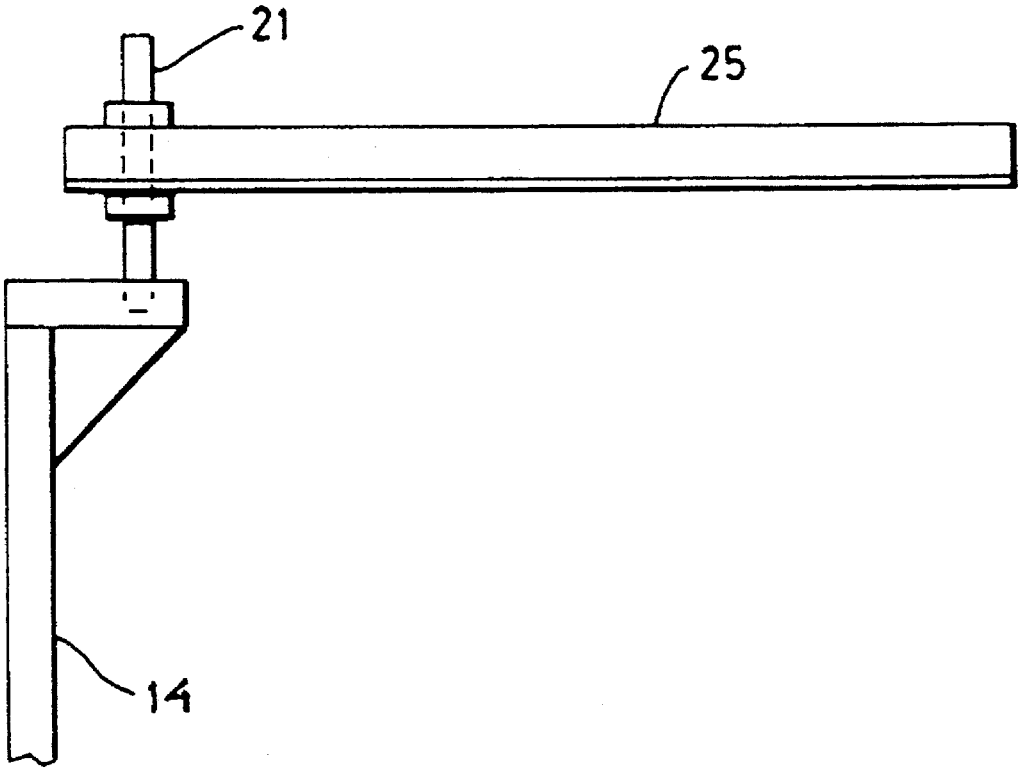
FIG. 6 is a side view of the adjustable stop plate assembly in accordance with the present invention.

In order to compensate for manufacturing and field assembly tolerances, the height of the sliding gate 25 can be adjusted with a pair of adjusting bars 21 (only one shown) which are clamped to the sliding gate 25 and coupled to the slide gate mounting plate 14, as shown in FIG. 6.

Figure 4:
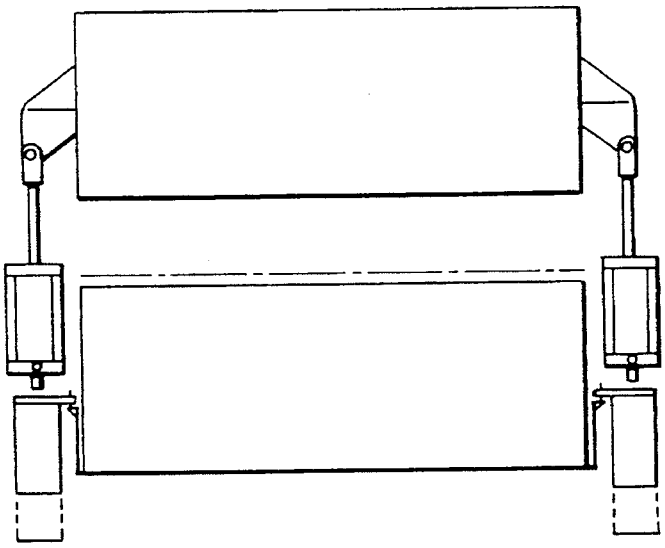
FIG. 4 is a side view of the dryer of FIG. 2.

The operation of the retraction locking system of the present invention can be described as follows. When the dryer is in the unretracted mode (i.e, the hood is closed) as shown in FIGS. 1 and 3, each cylinder rod 30 is positioned through an aperture in the base 8 of each retraction locking device. When the dryer is moved into a retracted position (i.e., the hood is open) as shown in FIGS. 2 and 4, the fluid cylinder 35 is activated, which causes a shift of sliding gate mounting plate 14 associated with one of the air cylinders 20, which in turn moves flat bar 5 and causes the other sliding gate mounting plates 14 associated with the remaining air cylinders 20 on that side of the dryer to shift, thereby causing the sliding gate 25 to slide under the cylinder rod 30 and block its return motion into the aperture in the base 8, thereby preventing the dryer hood from lowering. A limit switch 40 can be employed to prove that the slide plate 25 is in position or out of position.

What is claimed is:

1. A retraction locking system for a dryer having first and second hoods retractable with respect to each other, said retraction locking system comprising:

a base having an aperture operative to receive a rod when said first and second hoods are retracted in a hood closed first position with respect to each other;

a cylinder having said rod, said rod having a first end fixed to said first hood, and a second end moveable with respect to said base between said hood-closed first position wherein said rod is received in said aperture, and a hood-retracted position wherein said rod is retracted from said aperture; and means for blocking said rod, when said rod is retracted from said aperture from re-entering said aperture.

2. The retraction locking system of claim 1, wherein said means for blocking said rod comprises a sliding gate slidable over said aperture in said base.

3. The retraction locking system of claim 2, wherein said sliding gate is coupled to a sliding gate mounting bracket.

4. The retraction locking system of claim 3 further comprising a plurality of said sliding gate mounting brackets coupled together via a flat bar, so that movement of one of said sliding gate mounting brackets causes movement of other sliding gate mounting brackets.

5. The retraction locking system of claim 4, wherein said movement of one of said plurality of sliding gate mounting brackets is caused by a fluid cylinder.

6. A method of locking a first load in a retracted position with respect to a second load, comprising:

retracting said first load with respect to said second load;

providing a retraction locking system comprising:

a base mounted on said second load, said base having an aperture;

a cylinder having a rod, said rod having a first end fixed to said first load, and a second end moveable with respect to said base between a load-closed position wherein said rod is received in said aperture, and a load-retracted position wherein said rod is retracted from said aperture; and blocking said rod, when the first load is in a retracted position with respect to the second load, from re-entering said aperture.

7. The method of claim 6, wherein said rod is blocked by moving a sliding gate over said aperture in said base.

8. A retraction locking system for locking a first load in a retracted position with respect to a second load, said retraction locking system comprising:

a base mounted on said second load, said base having an aperture;

a cylinder having a rod, said rod having a first end fixed to said first load, and a second end moveable with respect to said base between a load-closed position wherein said rod is received in said aperture, and a load-retracted position wherein said rod is retracted out of said aperture; and means for blocking said rod, when the first load is in a retracted position with respect to the second load, from re-entering said aperture.

9. The retraction locking system of claim 8, wherein said means for blocking said rod comprises a sliding gate slidable over said aperture in said base.

10. The retraction locking system of claim 9, wherein said sliding gate is coupled to a sliding gate mounting bracket.

11. The retraction locking system of claim 10 further comprising a plurality of said sliding gate mounting brackets coupled together via flat bar, so that movement of one of said sliding gate mounting brackets causes movement of other sliding gate mounting brackets.

12. The retraction locking system of claim 11, wherein said movement of one of said plurality of sliding gate mounting brackets is caused by a fluid cylinder.

* * * * *